US007144044B2

(12) United States Patent
Legrand

(10) Patent No.: US 7,144,044 B2
(45) Date of Patent: Dec. 5, 2006

(54) FOAM BOOK WITH IMPROVED BINDING AND METHOD II

(76) Inventor: Christian Noël Guy Legrand, 100/203 Chonlada Village, District Ban Bua Thong Nonthaburi Province 11110 (TH)

( * ) Notice: Subject to any disclaimer, the term of this patent is extended or adjusted under 35 U.S.C. 154(b) by 455 days.

(21) Appl. No.: 10/664,470

(22) Filed: Sep. 17, 2003

(65) Prior Publication Data

US 2004/0130138 A1 Jul. 8, 2004

(30) Foreign Application Priority Data

Jan. 3, 2003 (TH) ..... 0303000006

(51) Int. Cl.
*B42C 19/06* (2006.01)

(52) U.S. Cl. ..... 281/15.1; 281/36; 281/38; 281/21.1; 281/40; 412/1; 412/4; 412/6

(58) Field of Classification Search ..... 281/15.1, 281/40, 38, 36, 21.1; 412/1, 4, 6, 19
See application file for complete search history.

(56) References Cited

U.S. PATENT DOCUMENTS 4,280,241 A * 7/1981 Pfaff ..... 412/3
5,605,425 A * 2/1997 Schaefer ..... 412/4
5,676,482 A * 10/1997 Hawkins ..... 402/79
6,364,360 B1 * 4/2002 Kaufman ..... 281/15.1
6,702,331 B1 * 3/2004 Derraugh et al. ..... 281/38

* cited by examiner

*Primary Examiner*—Willmon Fridie, Jr.
(74) *Attorney, Agent, or Firm*—Adam H. Jacobs

(57) ABSTRACT

A method of binding a book including the steps of providing a front cover page, a rear cover page and at least two center pages each constructed of a foam material and providing at least two binding sheets. A first center page is mounted on a first binding sheet with a connection portion of the first binding sheet not being covered by the first center page. Another center page is mounted on another binding sheet in the same manner. The first center page is then mounted on one of the front and rear cover pages and the connection portion of the first binding sheet is connected to an adjacent center page. The connection portion of the another binding sheet is then connected to the other of the front and rear cover pages and the front, rear and center pages are thus bound in book format.

6 Claims, 3 Drawing Sheets

FOAM BOOK WITH IMPROVED BINDING AND METHOD II

CROSS-REFERENCE TO RELATED FOREIGN PATENT

This application claims priority based on a foreign patent, specifically on the Thailand Petty Patent Serial No. 0303000006 filed Jan. 3, 2003.

BACKGROUND OF THE INVENTION

1. Technical Field

The present invention relates to binding methods for books and, more particularly, to a binding apparatus and method for foam books which includes a cover sheet having a front cover page section, a rear cover page section and a spine section extending between and connecting the front and rear cover page sections, at least two center foam pages positioned between the front and rear cover pages, and at least two binding sheets, each of the center foam pages mounted on one of the binding sheets, the binding sheets connecting adjacent center foam pages and further connecting the center foam pages to the inner surfaces of the front and rear cover page sections such that the pages are secured to one another and to the cover sheet to securely bind the book.

2. Description of the Prior Art

There are many different kinds of books and bookbindings which are currently used in the publishing industry. While the majority books are constructed of paper and paper products, there are many types of children's books which are constructed of different materials such as cloth, foam or the like, in order to provide additional tactile sensations for the children reading the books. Currently, it is becoming popular to manufacture children's books from thin plates of foam which constitute the pages and front and rear covers. These are bound in various types of ways such as by gluing the pages to one another, stapling the pages or binding them with a loom as is done with paper-paged books. Each of these binding methods includes inherent defects, however, such as that books bound with staples will become rusty and eroded when exposed to water, those bound with a loom will wear out due to the construction method and materials and books bound with glue tend to not last very long when used by children due to the intensity of the use to which they are subjected. There is therefore a need for an improved book construction for children's foam books which will overcome many of the deficiencies found in the prior art.

Bookbinding generally has three popular types that have been used for a long time are: (1) Bookbinding by sewing/gluing is taking the book to be sewn by the equipment so called sewing by cord. After that the book spine is glued, the sewn pages are attached to the cover; (2) Bookbinding by the spine planing-gluing is to plane the sheets with a planing knife so the book spine can be serrated (for the glue can be applied as much as possible and glued to the cover); and (3) Bookbinding by stitching the roof is stitching the sheets to the covers using staples. While each of these prior art methods and devices will bind the pages of the book together, none of them fully addresses and solves the deficiencies inherent in the prior art, specifically that spine-connecting binding methods will quickly wear out and result in pages of text being lost.

It is therefore a object of the present invention to provide a foam book having an improved binding.

Another object of the present invention is to provide a foam book with an improved binding which will substantially increase the durability and longevity of the book.

Another object of the present invention is to provide a foam book having an improved binding in which the pages of the book are connected to one another by a series of connected foam plates to which the thicker pages of the book are attached.

Another object of the present invention is to provide a foam book having an improved binding in which the foam plates are approximately twice the width of the attached pages so that the foam plates can be securely adhered to the pages.

Another object of the present invention is to provide a foam book having an improved binding which will permit a virtually unlimited number of pages to be bound together without sacrificing the binder strength and longevity.

Finally, an object of the present invention is to provide an improved foam book with an improved binding which is relatively simple to manufacture and is safe and durable in use.

SUMMARY OF THE INVENTION

The present invention provides a method of binding a book including the steps of providing a front cover page, a rear cover page and at least two center pages each constructed of a foam material and providing at least two binding sheets. A first one of the at least two center pages is mounted on a first one of the at least two binding sheets with at least a connection portion of the first binding sheet being free of coverage by the first center page. Another one of the at least two center pages is mounted on another one of the at least two binding sheets with at least a connection portion of the another binding sheet being free of coverage by the another center page. The first center page is then mounted on one of the front and rear cover pages and the connection portion of the first binding sheet is connected to an adjacent one of the at least two center pages. The connection portion of the another binding sheet is then connected to one of the front and rear cover pages opposite the mounting of the first center page and the method results in the at least two binding sheets connecting the at least two center pages to adjacent center pages and to at least one of the front and rear cover pages for binding the front cover page, the rear cover page and the at least two center pages in book format.

The improvements of the present invention over the prior art are easily seen and include the fact that the use of the binding sheets for secure adjacent pages to one another eliminates the likelihood that the spine of the book will eventually give out and release the center pages, as the pages are not connected to the spine at all. Furthermore, the elimination of staples as a binding agent eliminates the possibility of injury due to contact with the staples, as the binding sheets which are used in the present invention are soft and flexible. Furthermore, the appearance and durability of the book of the present invention is significantly enhanced due to the use of the binding sheets, and it is fully expected that various types of binding sheets and pages may be used which provide further enhancement to the book. Also, the use of the foam material is ideal for children's books, as it is safe and pliable and floats in water. Finally, because a virtually unlimited number of center pages may be bound together using the method of the present invention, the restrictions on the size, thickness and shape of the book formerly dictated by the prior art binding methods are substantially eliminated. It is therefore seen that the present invention provides a substantial improvement over those devices found in the prior art.

DESCRIPTION OF THE PREFERRED EMBODIMENT

Figure 1:
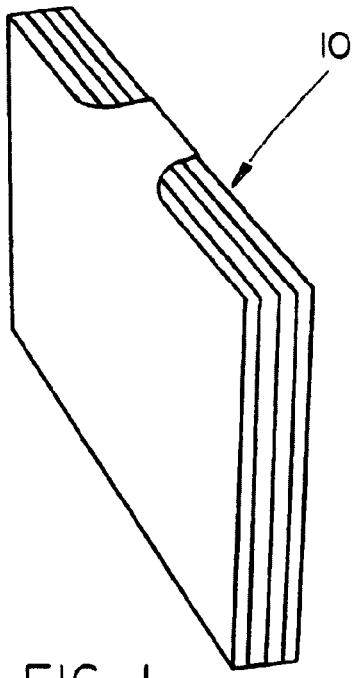
FIG. 1 shows the format of the book upon assembly completion.

The book with improved binding 10 of the present invention is shown best in FIGS. 1–10 as including a cover sheet 12 having a front cover page 13, a rear cover page 14 and a spine 15 connecting the front and rear cover pages 13 and 14. In the preferred embodiment, a book closing flap 40 is connected to and extends outwards from the front cover page 13 for securing the front and rear cover pages 13 and 14 to one another in closed position, although it should be noted that many different types of book access securement devices may be implemented with the present invention. Also, the book 10 will include a plurality of center pages 16*a*, 16*b*, 16*c* and 16*d* which are aligned in traditional book format. In the preferred embodiment, each of the pages 16*a*, 16*b*, 16*c* and 16*d* would be constructed of a foam material, specifically the foam marketed under the common name "EVA foam." "EVA foam" is a polymer foam made of ethyl-vinyl acetate and is particularly well-suited for the present application as it is safe, non-toxic and may be printed on quite easily. Furthermore, it is pliable and floats in water, thus making it a very suitable material for the construction of children's books. However, it should be noted that numerous other types of materials are suitable for use with the present invention so long as the safety and convenience feature of the present invention are maintained.

Figure 6:
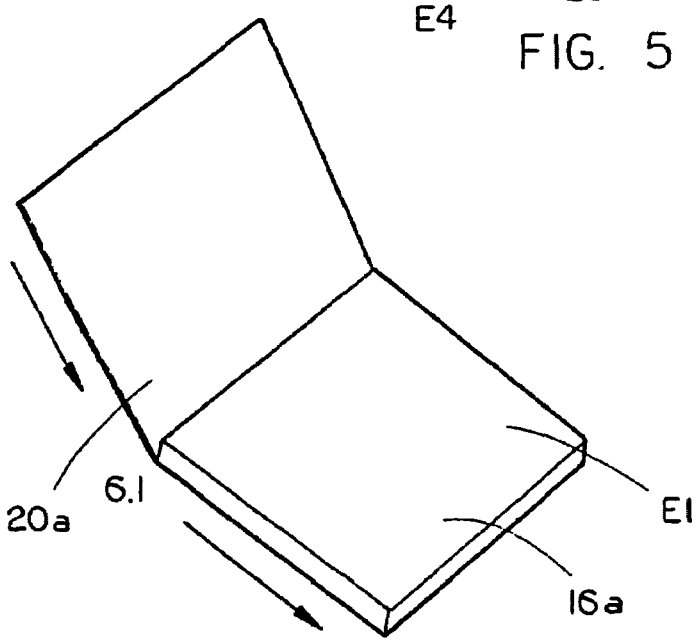
FIGS. 6, 7, 8, 9 and 10 illustrate the book assembly.
Figure 7:
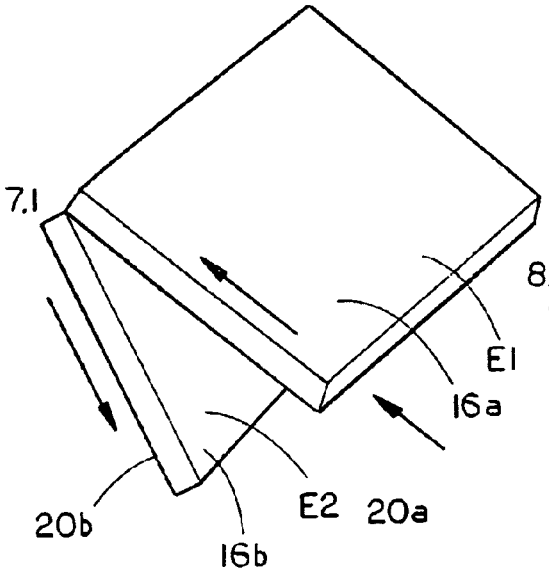

The binding method of the present invention is shown best in FIGS. 6–10 as including the following steps. Initially, a first binding sheet 20*a* of EVA foam is supplied, first binding sheet 20*a* having a width approximately equal to the total width of front cover page 13 and rear cover page 14, excluding the spine 15. First binding sheet 20*a* serves as a base to which the first center page 16*a* is attached, as shown best in FIG. 6, with first center page 16*a* being glued to the upper surface of first binding sheet 20*a*. By gluing the back surface of first center page 16*a* to the upper surface of first binding sheet 20*a*, the first center page 16*a* forms a two-sided page to which lettering, pictures or other such indicia may be applied. The first binding sheet 20*a* extends and is connected to a second center page 16*b* by gluing or the like such that the second center page 16*b* is hingedly attached to the first center page 16*a* via the first binding sheet 20*a*, as shown in FIG. 7. In this step of assembly of the book, the first binding sheet 20*a* may be attached to the top or bottom side of the second center page 16*b*, although it is preferred that the first binding sheet 20*a* be attached to the bottom side of the second center page 16*b* as shown in FIG. 7. The remaining center pages 16*c* and 16*d* would be connected in turn to an adjacent one of the center pages, starting with the second center page 16*b*, by third, fourth, etc. binding sheets 20*c*, 20*d*, etc., as was described in connection with the binding of first and second center pages 16*a* and 16*b*.

Figure 10:
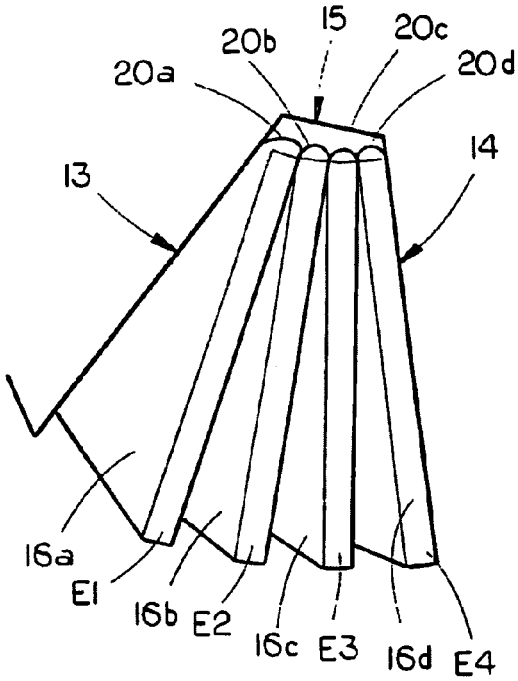

When the binding of the center pages 16*a*, 16*b*, 16*c* and 16*d* to one another is completed as described above, the center pages 16*a*, 16*b*, 16*c* and 16*d* are bound to the front cover page 13 and rear cover page 14 by gluing the outer face of the rearmost center page 16*a* directly to the rear cover page 14 and by gluing the unsecured section of the topmost binding sheet 20*d* to the front cover page 13, as shown best in FIG. 10. Upon the center pages 16*a*, 16*b*, 16*c* and 16*d* being secured within the cover sheet 12, the book binding method of the present invention is substantially completed, resulting in the bound book 60 shown in FIGS. 1 and 2. The binding method of the present invention thus does not require the connection of the center pages 16*a*, 16*b*, 16*c* and 16*d* to the spine 15 which is a source of weakness for many bound books. Furthermore, the binding method of the present invention does not restrict the number of pages or the size of the book due to the bound strength of the book, as each page is attached to the one adjacent. The spine of the book thus is not forced to carry the entire strength of the book.

Figure 2:
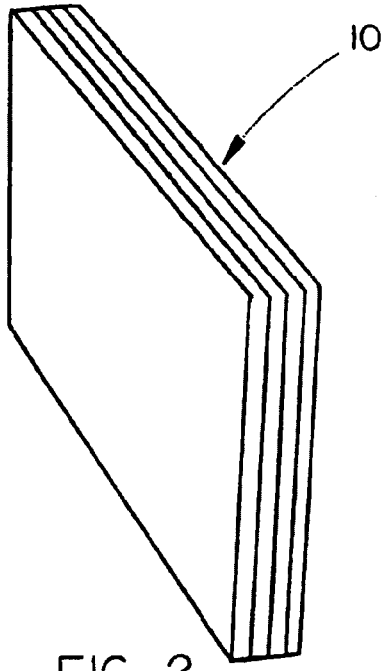
FIG. 2 shows the sheets separated from the covers (boards) (FIG. 3).
Figure 3:
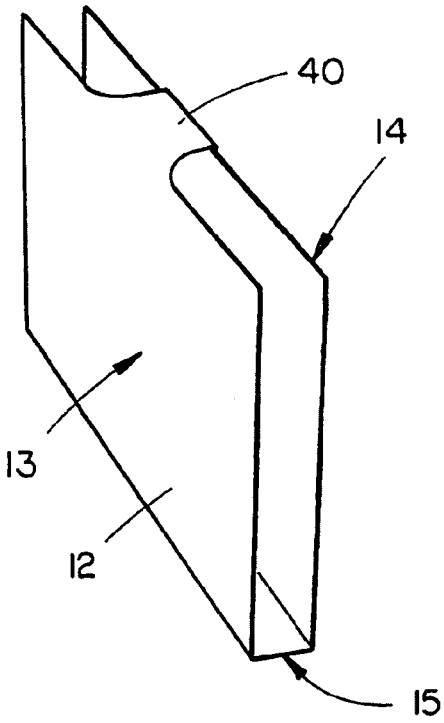
FIG. 3 shows the part that is the boards with the Velcro sticking out to catch the other side to hold down the sheets.
Figure 4:
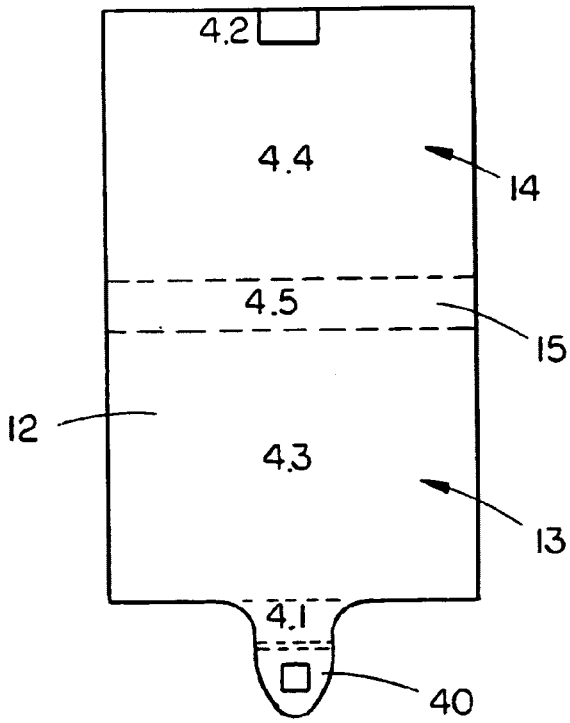
FIG. 4 is the width of the covers of the open book to show the rough surface is 4.2 and the smooth surface, while the front cover is 4.3 and the back cover is 4.4. while the book spine is 4.5, which is not glued.
Figure 5:
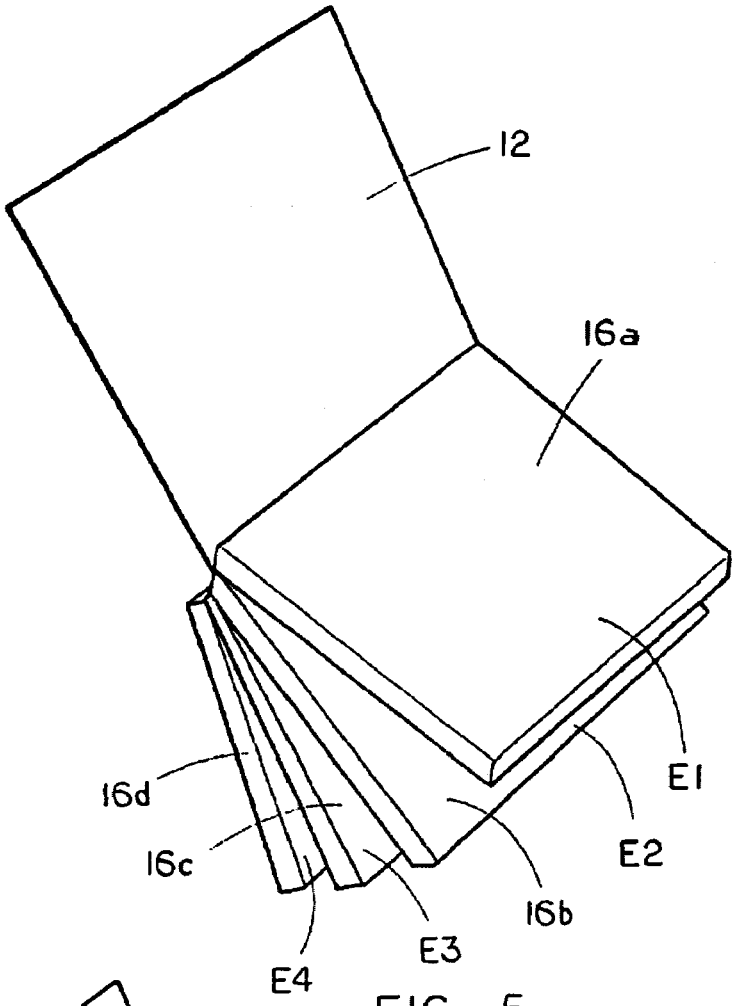
FIG. 5 shows the format of the book after the assembly in the horizontal position as illustrated.

An alternative description of the method of the present invention follows. FIG. 1 shows the format of the book upon assembly completion. FIG. 2 shows the sheets separated from the covers (boards)(FIG. 3). FIG. 3 shows the part that is the boards with the Velcro sticking out to catch the other side to hold down the sheets. FIG. 4 is the width of the covers of the open book to show the rough surface is 4.2 and the smooth surface, while the front cover is 4.3 and the back cover is 4.4. while the book spine is 4.5, which is not glued. FIG. 5 shows the format of the book after the assembly in the horizontal position as illustrated.

Figure 8:
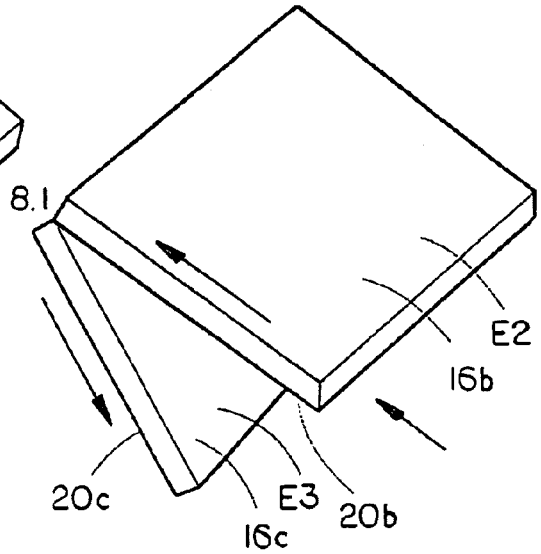
Figure 9:
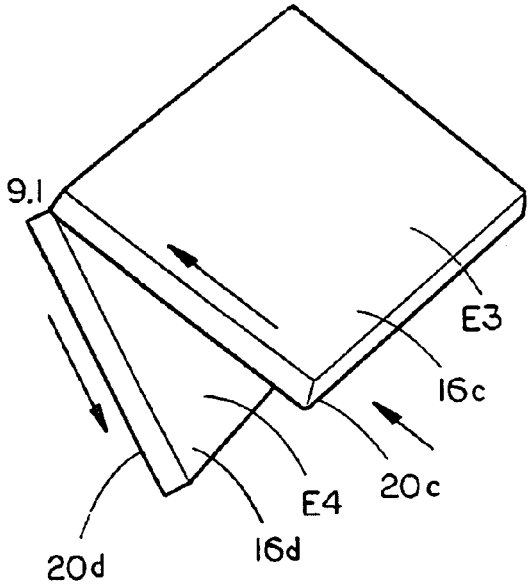

FIG. 6 shows the book assembly. First, bring two pieces of EVA Foam that is part 6.1 with its length equals to the covers in FIGS. 4.3+4.4 (that is the length of the cover excluding the spine). It acts like a base sheet to be assembled with the part E 1 the length equal to one half of the part 6.1 to be attached to its spine as illustrated. By gluing on the back of E 1 to be attached with the part of 6.1 in the back to have a double page book. FIG. 7 is the step in assembling of part 2 to the book by using two EVA Foam pieces, part of 7.1 with the length of the EVA foam equals to the covers as in FIGS. 4.3+4.4 (the length of the covers excluding the spine). They act as the base to be assembled with part E 1 having the length equals to one half of the piece 7.1 to be attached to the back as illustrated. By gluing on the back of E 2 to the part of 7.1 in the back to have another double page book. FIGS. 8 and 9 are repetitions of FIGS. 6 and 7 until they achieve the numbers of pages as required (which equals to the thickness of the spine as in FIG. 1, and when viewing from the above angle to show as in FIG. 10.

It is to be understood that the book with improved binding 10 of the present invention may include numerous additions, modifications and substitutions which will fall within the intended broad scope of the appended claims. For example, although the present invention has been described as being used in connection with binder cover and center pages 12 and 16*a*–*d*, it should be noted that two separate cover pages it is common in the book production field to fold pages over to form two pages joined by a crease, particularly with children's books in connection with the front and rear cover pages 12 and 14. These are often formed from a single longer piece of foam which is folded over to form the front and rear cover pages 12 and 14. Furthermore, the specific materials used in connection with the present invention may be modified or changed so long as the intended functional and use aspects of the invention are maintained. This would include substitution of various types of foam for the pages of the book and the substitution of various types of appropriate non-toxic waterproof adhesive or binding compound for the securement of the pages to one another in the methods of construction. In this manner, pages of various sizes and shapes may be bound to one another by utilizing the apparatus and methods of the present invention.

There has therefore been shown and described a foam book with improved binding and method which accomplishes at least all of its intended objectives.

I claim:

1. A method of binding a book comprising:

providing a front cover page, a rear cover page and at least two center pages each constructed of a foam material;

providing at least two binding sheets;

mounting a first one of said at least two center pages on a first one of said at least two binding sheets with at least a connection portion of said first binding sheet being free of coverage by said first center page;

mounting another one of said at least two center pages on another one of said at least two binding sheets with at least a connection portion of said another binding sheet being free of coverage by said another center page;

mounting said first center page on one of said front and rear cover pages;

connecting said connection portion of said first binding sheet to an adjacent one of said at least two center pages;

mounting said connection portion of said another binding sheet to one of said front and rear cover pages opposite said mounting of said first center page;

said at least two binding sheets connecting said at least two center pages to adjacent center pages and to at least one of said front and rear cover pages for binding said front cover page, said rear cover page and said at least two center pages in book format.

2. The method of claim 1 further comprising the step of connecting a plurality of connection portions of said another binding sheets to adjacent ones of said adjacent center pages for binding a plurality of center pages within said front and rear cover pages such that a book having plurality of pages is constructed.

3. A book comprising:

a front cover page, a rear cover page and at least two center pages each constructed of a foam material;

at least two binding sheets;

a first one of said at least two center pages mounted on a first one of said at least two binding sheets with at least a connection portion of said first binding sheet being free of coverage by said first center page;

another one of said at least two center pages mounted on another one of said at least two binding sheets with at least a connection portion of said another binding sheet being free of coverage by said another center page;

said first center page mounted on one of said front and rear cover pages;

said connection portion of said first binding sheet connected to an adjacent one of said at least two center pages;

said connection portion of said another binding sheet connected to one of said front and rear cover pages opposite said mounting of said first center page;

said at least two binding sheets connecting said at least two center pages to adjacent center pages and to at least one of said front and rear cover pages for binding said front cover page, said rear cover page and said at least two center pages in book format.

4. The book of claim 3 further comprising a plurality of binding sheets and a plurality of center pages, said connection portions of said plurality of binding sheets connected to adjacent ones of said plurality of center pages for binding said plurality of center pages within said front and rear cover pages such that a book having a plurality of pages is constructed.

5. The book of claim 3 wherein said front cover page, said rear cover page and said at least two center pages are constructed of a polymer foam made of ethyl-vinyl acetate.

6. The book of claim 3 wherein said at least at least two binding pages are constructed as thin sheets of foam material having a thickness substantially less than the thickness of said at least two center pages.

* * * * *